US011542622B2

(12) United States Patent
Bushby et al.

(10) Patent No.: US 11,542,622 B2
(45) Date of Patent: Jan. 3, 2023

(54) ELECTRODEPOSITION FROM MULTIPLE ELECTROLYTES

(71) Applicants: Queen Mary University of London, London (GB); Morganic Solutions Ltd., Romsey (GB)

(72) Inventors: Andrew John Bushby, London (GB); Ross Morgan, Romsey (GB)

(73) Assignees: Queen Mary University of London, London (GB); Morganic Solutions Ltd., Romsey (GB)

( * ) Notice: Subject to any disclaimer, the term of this patent is extended or adjusted under 35 U.S.C. 154(b) by 0 days.

(21) Appl. No.: 16/631,610

(22) PCT Filed: Jul. 17, 2018

(86) PCT No.: PCT/GB2018/052028

§ 371 (c)(1),
(2) Date: Jan. 16, 2020

(87) PCT Pub. No.: WO2019/016543

PCT Pub. Date: Jan. 24, 2019

(65) Prior Publication Data

US 2020/0165736 A1 May 28, 2020

(30) Foreign Application Priority Data

Jul. 17, 2017 (GB) ..... 1711472

(51) Int. Cl.
*C25D 17/00* (2006.01)
*C25D 1/00* (2006.01)
(Continued)

(52) U.S. Cl.
CPC ..... *C25D 17/00* (2013.01); *C25D 1/00* (2013.01); *C25D 5/10* (2013.01); *C25D 17/02* (2013.01); *C25D 21/08* (2013.01)

(58) Field of Classification Search
None
See application file for complete search history.

(56) References Cited

U.S. PATENT DOCUMENTS 1,593,397 A * 7/1926 Robinson ..... C25D 7/00 156/150
4,628,793 A 12/1986 Roth
(Continued)

FOREIGN PATENT DOCUMENTS

GB 1406801 9/1975
WO WO-2016046642 A2 * 3/2016 ..... C25D 1/00

OTHER PUBLICATIONS

L. Besra et al., "A review on fundamentals and applications of electrophoretic deposition (EPD)," Progress in Material Science 52, 1-61 (2007).

(Continued)

*Primary Examiner* — Louis J Rufo
(74) *Attorney, Agent, or Firm* — McDonnell Boehnen Hulbert & Berghoff LLP

(57) ABSTRACT

EL The present invention provides a system for electrodepositing a plurality of electrolytes onto a substrate in a single deposition chamber to form an article, in which the system comprises a removable substrate; a deposition chamber containing the substrate in which the chamber has an inlet and an outlet and in which the chamber comprises at least one anode with connection to a source of electrical current; a plurality of electrolyte reservoirs for an electrolyte solution connected to the deposition chamber through the inlet; and a rinse medium reservoir connected to the deposition chamber through the inlet. Also provided is a system comprising a cradle to form an article, methods using the systems of the invention, and composite materials and devices prepared by the methods of the invention.

14 Claims, 7 Drawing Sheets

(51) Int. Cl.

| | |
|---|---|
| ***C25D 17/02*** | (2006.01) |
| ***C25D 21/08*** | (2006.01) |
| ***C25D 5/10*** | (2006.01) |

(56) References Cited

U.S. PATENT DOCUMENTS

| | | | | |
|---|---|---|---|---|
| 5,543,028 | A | 8/1996 | Herbert et al. | |
| 5,830,805 | A | 11/1998 | Shacham-Diamand et al. | |
| 6,193,858 | B1 | 2/2001 | Hradil et al. | |
| 6,261,433 | B1 | 7/2001 | Landau | |
| 2004/0178076 | A1* | 9/2004 | Stonas | B22F 1/004 205/74 |
| 2006/0243597 | A1* | 11/2006 | Matefi-Tempfli | C25D 17/00 205/170 |
| 2014/0190835 | A1* | 7/2014 | Kojima | C25D 5/04 204/229.8 |
| 2016/0002803 | A1* | 1/2016 | Sklar | C25D 3/54 428/621 |
| 2019/0003070 | A1* | 1/2019 | Piascik | C25D 5/003 |

OTHER PUBLICATIONS

International Search Report of International Application No. PCT/GB2018/052028 dated Oct. 22, 2018, 2 pages.

* cited by examiner

ELECTRODEPOSITION FROM MULTIPLE ELECTROLYTES

This application is a U.S. National Stage application under 35 U.S.C. § 371 of International Patent Application PCT/GB2018/052028, filed Jul. 17, 2018, which claims the benefit of priority of United Kingdom Patent Application no. 1711472.9, filed Jul. 17, 2017.

The present invention relates to methods and systems for controlled deposition from multiple electrolytes.

Electrolysis has been used to deposit metals from solution for many years dating back to the work of Michael Faraday in 1834. The most common form of electro-deposition is electro-plating in which metal ions are deposited onto a conductive surface in an electric circuit from an electrolyte. The ions may be in solution in the form of metal salts or dissolved into the solution from an anode of the metal to be deposited. This is commonly performed as electro-plating for finishing or surface treatment of metallic surfaces. In general, a single pure metal is deposited in its own plating bath, the chemistry of which is manipulated to optimise the deposition of that metal. It is possible for some metal systems to co-deposit two or more metals simultaneously where the solution chemistry and deposition conditions allow. A lesser used technique is that of electrophoresis, in which an insulating species in solution is deposed onto an electrode by the action of an electric field. As the deposit builds up the electrode becomes insulating and the process stops. Lacquers may be applied to metal surfaces in this way.

A variant of electro-deposition is electro-forming, in which metal is deposited by electrolysis onto a temporary preform (model or mandrel) that may be removed afterwards to leave a free standing or hollow part. Typically the processes of electroplating are followed so that a single metal is deposited from a single electrolyte plating bath. It was used in the construction of the Statue of Liberty in 1886.

The deposition of multilayer materials is usually achieved by vacuum technologies such as physical vapour deposition where the metal ion for deposition is released from a target material by magnetron sputtering, electron beam evaporation or other high energy process. By using two or more targets sequentially, multi-layers of dissimilar metals can be built up. The method usually requires line of sight from target to surface and is conducted as a batch process in closed vessels. Similar processes by chemical vapour deposition techniques are also possible with less constraint on the shape of the object to be coated. All of these multilayer techniques are slow and expensive.

Electro-deposition of different metals to the same piece usually requires moving the work from one plating bath to another to satisfy the different deposition conditions and to not contaminate each electrolyte. If depositions in different parts of the piece are required, masking and repositioning of anodes is necessary at each step in the process. However, this is commonly done, even though it is time consuming, to provide adhesion and finish to the component. Deposition of multilayers of two different metals by electro-deposition is possible for some systems (e.g. Cu—Ni). A single electrolyte containing salts of both metal ions is used that deposit at different current densities. By sequentially switching from high to low current density, multilayers may be formed consisting of high proportions of each metal with small amounts of the other.

The present invention seeks to provide a means to produce metallic components to a desired shape by a relatively cheap, efficient and flexible process.

This invention seeks to overcome the disadvantages of the processes described above through the deposition of metals or other materials from a series of different electrolytes onto a temporary pre-form substrate within a single vessel or through use of a cradle.

According to a first aspect of the invention there is provided a system for electrodepositing a plurality of electrolytes onto a substrate in a single deposition chamber to form an article, in which the system comprises (i) a removable substrate;

(ii) a deposition chamber containing the substrate in which the chamber has an inlet and an outlet and in which the chamber comprises at least one anode with connection to a source of electrical current;

(iii) a plurality of electrolyte reservoirs for an electrolyte solution connected to the deposition chamber through the inlet; and (iv) a rinse medium reservoir connected to the deposition chamber through the inlet.

The substrate may be of any convenient form for a material to be fabricated using the method according to the invention. The substrate may alternatively be referred to as a work piece, pre-form, a mould, a mandrel or a model. In general, the substrate is removable, in that it is removable from the material (the article) that has been fabricated by the electrodeposition. The substrate may be thermolabile, cryosensitive or soluble. Thermolabile (temperature sensitive) or cryosensitive substrates include substrates that are removed from the article by heating to above the melting temperature of the substrate, by thermal degradation, or by exposure to low temperatures (e.g. to fracture brittle substrates). Soluble substrates include substrates that are acid soluble, base soluble, organic solvent soluble, water soluble, or otherwise dissolvable (e.g. a soluble polymer).

The substrate may be a wax model or wax pre-form onto which the electrolytes are to be deposited. The substrate may comprise a filled wax or a non-filled wax. The substrate may comprise a wax blend, comprising petroleum waxes, natural waxes and/or resins. The wax substrate may further comprise fillers (e.g. china clay). Alternatively, the substrate may be a soluble polymer (e.g. polystyrene, polyvinyl chloride, polylactic acid, polylactic-co-glycolic acid). The soluble polymer may be obtained through plastic extrusion or moulding or using a three-dimensional printed model. Suitable three-dimensional printed materials also include wax.

The substrate may act as a temporary electrode.

The substrate may also be a metal pre-form (e.g. stainless steel). Such a pre-form is removable by heating. Suitably the substrate may be designed to facilitate removal (e.g. tapered or convex).

In some arrangements, multiple substrates may be present in the deposition chamber.

The deposition chamber may be formed as a vessel in any convenient shape, such as for example a cylindrical form. The chamber may be formed from a wall element, for instance to form a cylinder and provided with end caps at each end to form a closed vessel. The end caps may be provided with electrode connections and inlets and/or outlets as required.

The deposition chamber inlet and outlet may be combined and provided at the same location. In other arrangements, a plurality of inlets and outlets may be present. So it is envisaged that at least one outlet and at least one inlet is provided in the deposition chamber.

Parallel deposition chambers may also be used in some arrangements. The reservoir of electrolyte may be connected to more than one deposition chamber. Similarly, the reservoir of rinsing medium may be connected to more than one deposition chamber.

Inside the deposition chamber, an agitation device may be provided, such as a stirrer, turbine or similar. Suitably a temperature sensor and/or a pH sensor may be present. A heater may be provided also. The heater may be internal or external.

The electrode connections serve to provide electric current to the at least one anode and the work piece or substrate.

Optionally, the plurality of electrolytes may be provided with a control system for monitoring concentration and regulating flow of electrolyte to the deposition chamber. Once electrolyte solution has been allowed to flow into the deposition chamber, the action of electrical current at the anode or anodes causes the metal ions in solution to be deposited in the chamber on the substrate. Suitably, the flow is continuous and in a controlled manner. Any unused electrolyte is allowed to leave the deposition chamber through the outlet. The electrolyte may be returned to the electrolyte reservoirs, optionally such recycled electrolyte may be filtered also before being returned to the reservoirs. The electrolyte may be replenished in the reservoir with a consumable anode so the concentration in the reservoir remains constant. It is generally preferred that there is always a surplus of ions in the deposition chamber.

The electrolyte solutions may be allowed to circulate in a continuous flow. The flow of electrolytes from individual reservoirs can be switched on or off in order to permit a controlled flow of electrolyte solution to the deposition chamber. In operation, the invention therefore provides switchable electrolytes in a continuous flow.

In one embodiment of this aspect of the invention, the electrolyte solutions and rinsing medium may be connected to the deposition chamber through a single fluid connector via a sealable control valve. However, it is envisaged that multiple fluid connectors could equally be used to connection to the deposition chamber via the inlet or via multiple inlets.

The outlet of the deposition chamber may be provided with a fluid connection for recycling of the electrolyte solution to the reservoirs and/or disposal of electrolyte. The connection may include a control valve, optionally a sealable control valve.

At least one anode may be connected to the source of electrical current by a switch which can provide for different amounts of electrical current to be supplied to different electrodes (anodes). The anode is suitably an insoluble anode. However, a dissolvable anode may also be used if desired.

More than one anode may be present. Consequently, the invention provides a system as defined above which uses a multiple deposition electrolyte as defined herein in a single vessel to deposit metal using multiple electrodes. Where there is a plurality of anodes, each anode may be located at a different position relative to the substrate. A plurality of anodes refers to two or more anodes.

The electrolyte reservoirs may supply a plurality of such deposition vessels in parallel, to deposit at the same time or different times as desired. The system may therefore also allow for the process to be run in parallel from the same electrolyte reservoirs independently or synchronously. It is also envisaged that different electrolytes can be supplied to different deposition vessels. The fluid feed of electrolyte from the reservoirs can therefore also be shared between deposition vessels.

The pre-form (substrate) and the deposition chamber (vessel) may be of similar shape to minimise the volume of electrolyte required and to position the anodes at precise positions with respect to the pre-form. The vessel may contain a number of anodes that may be energized singly or collectively in any sequence to deposit metal on different parts of the work. The process can be thought of as a "factory in a bottle".

The plurality of electrolytes may differ in terms of the metal ions present or in the concentration of the particular metal ions present if the same element in question is present in all electrolyte solutions. Co-deposition of metal ions may be suitable in some instances. The metal ions in the electrolyte solutions may therefore be identical or non-identical. However, in the case where the same metal ions are present in the electrolyte solutions in the plurality of electrolyte reservoirs it is envisaged that the concentration of the metal ions may suitably vary across the different electrolyte reservoirs.

Suitably, the metal ions may be present in acidic or ammoniacal solutions. Examples of such electrolyte solutions may include one or more transition metal ions (e.g. vanadium (V), chromium (Cr), manganese (Mn), iron (Fe), cobalt (Co), nickel (Ni), copper (Cu), or combinations thereof), noble metals (e.g. ruthenium (Ru), rhodium (Rh), palladium (Pd), silver (Ag), osmium (Os), iridium (Ir), platinum (Pt) and gold (Au), or combinations thereof), zinc (Zn), tin (Sn), or combinations thereof. An example of a suitable combination is co-deposition of nickel/cobalt (Ni/Co).

Exemplary metal ions include but are not limited to one or more metal selected from the group consisting of silver (Ag), gold (Au), palladium (Pd), copper (Cu), iron (Fe), cobalt (Co), nickel (Ni), zinc, (Zn) and tin (Sn).

Other electrolyte systems which can be used in a system of the invention include, but are not limited to:

- Electroless solutions, for example electroless nickel made by the reduction of nickel ions with hypophosphite.
- Electrolytes including a suspension of sub-micrometre particles, e.g. colloidal silica, carbon nanotubes, carbon black, etc.
- Specialized electrolytes for depositing functional ceramics, for example Yittria Stabilized Zirconia (YSZ), Lead zirconate titanate (PZT)—see Besra et al., *Materials Science* 52, 1-61 (2007).
- Electrophoretic solutions for depositing non-conductors, for example polymer solutions that can deposit a polymeric coating onto the conducting surface; including but not limited to: polyesters, polyurethanes, polyamides, polyester-imides, polyamic acids, polyamide-imides, epoxides, etc. and mixtures thereof.
- Sacrificial layers, e.g. Cu, Sn, Zn.

The rinsing medium may be water or any suitable medium for cleansing the deposition chamber after use or between individual electrodepositions from the separate electrolyte reservoirs.

According to a second aspect of the invention, there is provided a system for electrodepositing a plurality of electrolytes onto a substrate to form an article, in which the system comprises (i) a removable substrate;
(ii) a cradle containing the substrate in which the cradle comprises at least one anode with connection to a source of electrical current;
(iii) a plurality of electrolyte solution baths; and
(iv) a rinse medium bath.

The system may comprise a plurality of cradles. A plurality of cradles refers to two or more cradles.

According to a third aspect of the invention there is provided a method for electrodeposition of different metals from a plurality of electrolytes on a substrate to form an article, in which the electrodeposition occurs in a single deposition chamber comprising using a system in accordance with the first aspect of the invention, said method comprising forming an article by electrodeposition of different metals from a plurality of electrolytes on a removable substrate. In the practice of this aspect of the invention, a plurality of electrolytes are electrodeposited onto a removable substrate to form an article. The method thereby forms a metal composite. The method may further comprise the step of removing the substrate from the article.

According to a fourth aspect of the invention, there is provided a method for electrodeposition of different metals from a plurality of electrolytes on a substrate to form an article, in which the substrate is held in a cradle, comprising using a system in accordance with the second aspect of the invention, said method comprising forming an article by electrodeposition of different metals from a plurality of electrolytes on a removable substrate. In the practice of this aspect of the invention, a plurality of electrolytes are electrodeposited onto a removable substrate to form an article. The method thereby forms a metal composite. The method may further comprise the step of removing the substrate from the article.

In any system or method of the invention, multiple substrates may be present in the deposition chamber or cradle. In one embodiment, the multiple substrates can be used to create components comprising multiple concentric layers. The substrates may be used sequentially. For example, a metal or metals may be electrodeposited on a first substrate, and then a second substrate may be placed on the electrodeposited metal, and the electrodeposition may be repeated.

In any aspect of the invention, the deposits may also be distinguished from one another by being different metals or by the inclusion of fine particles suspended in the electrolyte and included in the deposit as it forms on the substrate (work) making an aggregate embedded in the metal (e.g. fumed silica particles, carbon nanotubes). The invention therefore provides for the formation of 3-dimensional objects.

In one embodiment of the invention, the method further comprises providing different levels of electrical current to the anodes at different locations in the deposition chamber or the cradle. The provision of different levels of electrical current allows for the formation of different thicknesses of different deposits and various locations in the formation of the same object.

The at least one anode may be positioned to ensure provision of different levels of current to different regions in the deposition vessel or the cradle. In other words, a plurality of anodes may be used where each anode is located at a different position in the deposition vessel or the cradle.

According to the present invention, the different thicknesses of the different deposits can therefore be made at different places in the same object—enabling adjustable or "tuneable" strength, stiffness, thermal expansion coefficient, etc. through "length-scale engineering" of the materials properties. This may be achieved by different current density or different deposition time.

In practice therefore, the operator of the system can choose to vary the strength of the material being formed at any given location. The invention therefore enables a combination of properties to be selected for any given location in the object being formed by the electrodeposition system defined herein. In particular, the strength of the object can be manipulated or engineered to be improved over the strength of an object formed simply from the starting materials without such electrodeposition.

This embodiment of the invention allows for the controlled deposition of different metals with different layer thickness at different places in the same object—with the advantage of controlling the local mechanical properties or other properties of the object such as the thermal expansion coefficient. The properties can therefore by varied as desired or "tuned" by increasing or decreasing the electrical current supply and/or time the electrical current is applied.

The system may also comprise one or more non-conducting field modifiers that modify the electric field distribution, providing further control of current density and hence local deposition rates. These non-conducting materials may be positioned between the anode(s) and substrate. The non-conducting field modifiers may be baffles.

In another embodiment of the methods of the invention, the method may comprise the deposition of two metals which form an alloy on heating (for example, silver (Ag) and gold (Au)), wherein the method further comprises selective removal of one element from the metal composite which thereby forms a microporous surface. Advantageously, the microporous surface may have a high surface area.

In the methods of the invention, the process of electrodeposition may be carried out at a variety of conditions as required in order to prepare the articles desired. Some optionally preferred values may be as follows.

The electrodeposition process may be carried out at room temperature and pressure. However, it may be preferable to conduct the process in the range of from 25° to 35° C., for example at 30° C. The deposition temperatures of the different materials deposited may be the same in the process.

Typical current densities may be in the range of from 1 to 20 amp/dm$^2$, suitably of from 1 to 2 amps/dm$^2$ for example 1.5 or 2 amp/dm$^2$.

The concentration of electrolytes may be of from 20 g/L to 500 g/L, suitably of from 80 to 150 g/L, for example less than 100 g/L.

The pH of the electrolyte solution will depend on the specific electrolyte solution in question, the value may vary therefore from pH 1 to pH 10. Some exemplary ranges include pH 1 to pH 2, or pH 7 to pH 8.

The time taken for the process to complete will depend on the article being formed. Deposition rates may be from 10 to 20 micrometres/hour. The time taken for each article to be prepared may therefore vary from 0.25 hours to 20 hours, for example 0.5 hours, 5 hours, 10 hours, 15 hours. For example, for an article with 150 micrometre wall thickness the time taken may be around 18 hours in total.

The yield strength of the articles formed can be adjusted as described herein between 100 MPa and 1800 MPa, suitably from 300 MPa to 1500 MPa, for example 750 MPa or 1500 MPa. Similarly, the coefficient of thermal expansion can be adjusted between 9 micrometres/metre/Kelvin to 19 um/m/K. Likewise the elastic modulus can be adjusted to between 100 GPa and 220 GPa The thickness of the layers may be from 100 nm to 50 micrometres, suitably 0.1 micrometres to 10 micrometres, or 10 to 20 micrometres.

According to a fifth aspect of the invention, there is provided a composite material comprising at least two elements. Such composites may be formed from two metals to form a metal composite. The metals may be of an immiscible system to form a multi-layered composite obtainable using the methods according to the invention.

An example of such a metal composite is a composite of copper-iron (Cu—Fe). The two metals, e.g.

Fe and Cu are deposited separately but being immiscible will remain separate and do not form an alloy on heating.

The metals to be deposited may include non-metal particles in order to prepare multilayers of pure metal and metal including particles. Such particles can be formed from ceramic or organic compounds. Examples of such particles include but are not limited to silica, carbon fibres, boron filament, boron nitride, boron carbide, graphite, carbon nanotubes, diamond, aramid, glass fibres, and silicon carbide. The non-metal components may also be present in the form of fibres, monofilament wires or microparticles.

Such composites may also include non-metals, so this aspect of the present invention extends to a composite formed of metals and non-metals, for example a ceramic or organic compound.

The composition of the composite material may vary locally, with respect to different regions of the article. In other words, the composition may differ in terms of thickness and/or ratio of metals/non-metals at certain areas of the material. This can allow tuning of the properties of the composite material, so that different areas of the material have different properties.

Where multiple substrates are used, a composite material comprising multiple concentric layers can be provided.

According to a sixth aspect of the invention, there is provided a device incorporating a metal composite, or composite of metals and non-metals, of the fifth aspect of the invention.

Devices according to the invention may comprise multiple parts (e.g. connectors, flanges) that are integrated in a single piece by the electrodeposition process.

One suitable embodiment of the system of the invention is shown in FIG. 1. Another suitable embodiment of the system of the invention is shown in FIG. 4.

There are several advantages of the present invention as follows. The metals can be deposited in different thickness at different locations in the work to vary the mechanical or chemical properties locally. Multiple metal depositions can be made without disturbing the component, re-jigging the anodes or masking the surface. The invention allows for production of multi-functional components without the need for separate joining or forming operations (e.g. the inclusion of fittings into the component, or structure and heat management in a single component). Consequently, the invention represents a seamless process that can easily be automated and is scalable for production. There is no hard tooling required to perform the invention. Pre-forms and the containing vessels can be made by soft processing (3D-printing, wax casting or injection moulding) and re-used or not as necessary. The same hardware can be used to make one-off components or production runs of thousands. Components can be electro-formed using more than two metals while in the same vessel.

The deposition vessels or cradles may be bespoke to the component being produced. The anodes in the vessel or cradle may be insoluble (e.g. carbon or platinised titanium) and not consumed in the process but simply supply electrical charge.

According to the first and third aspects of the invention (relating to the deposition chamber), the electrolytes containing the metal ions in solution can be pumped from holding tanks in which a consumable electrode of the deposited metal is used to maintain concentration of solution. The deposition chamber (vessel) includes inlets and outlets for the electrolyte (suitably at each end of the chamber) and a system for rinsing between deposition steps. The electrolytes and rinse may be fed in and out of the vessel via a series of valves. Electrical connections through are provided to the work piece and insoluble anode.

The advantageous features of the present invention can be summarised as the provision of new methods for preparing 3-dimensional (3D) objects using electrodeposition and new alloy systems. The new devices incorporating materials prepared according to the present invention have superior properties based on the properties of the materials.

The ability to create 3-dimensional articles with different thicknesses and compositions at different locations is highly desirable, but the prior art systems do not appear to offer this facility.

The new alloy system may permit the formations of alloys or multilayers of metals that previously were not thought capable of mixing.

The principle of this method, that makes it different from conventional electroforming, is the controlled deposition of different metals with different layer thickness at different places in the same object (substrate). This allows the control of structural and mechanical (or thermal) properties locally, while making a complete object or component. With conventional electroplating or electroforming, the aim is for uniform deposition across the substrate.

Additionally, the use of a deposition vessel differs from conventional electroplating or electroforming, as the electrolytes are taken to the work piece rather than the work piece to the electrolyte.

This can be achieved by placing the work piece in a separate container, (the deposition vessel) into which the different electrolytes may be passed in a sequence that achieves the desired microstructure in the component being manufactured. The deposition vessel could be a tube that may be mounted vertically or at some angle to allow liquid to easily flow in or out or similarly a bath in which the work piece is submerged but fluid can be exchanged. The deposition vessel is designed to minimise the amount of electrolyte required at the place of deposition. The vessel consists of a container, the ends of which include manifolds to allow fluid to flow in and out, and at least one electrode.

The deposition vessel may contain multiple electrodes that can be placed at specific distances from the work piece and excited individually or collectively. The multiple electrodes (anodes) may be included in different positions to deposit in different regions and at different deposition rates (current density).

Non-conducting materials may be positioned between the electrodes and work piece to modify the electric field distribution, providing further control of current density and hence local deposition rates. Such non-conducting materials can be referred to as non-conducting field modifiers. The non-conducting materials may be formed by, for instance, casting, 3D printing, laser cutting, moulding, etc.

The vessel may also include heating elements to maintain the electrolyte at a specific temperature as well as sensors for temperature and pH of the solution and agitation devices (e.g. impellors or ultrasonic devices) to ensure exchange of fluid to all areas of the part including recesses.

Schematic diagrams of possible deposition vessel arrangements are shown in FIGS. 2 and 3.

An example workflow is shown in FIG. 7. Examples 1, 2 and 5 describe possible embodiments of the invention, using a deposition chamber.

As with conventional electroforming, the process starts with a pre-form or mandrel that defines the inside surface of the component. The mandrel may be removed at the end of the process or retained inside the work. Suitable mandrel materials are plastic extrusions (e.g. soluble polymers) or mouldings (e.g. from moulds/casts constructed from plaster, wax or silicone rubber) or, more commonly these days, 3D printed objects created from a CAD drawing of the interior dimension of the object.

The surface of the mandrel is electrically conducting (suitably with a resistivity less than 1000 ohm metres) to create the initial electrode. This may be achieved in a number of ways depending on the application:

1. Electroless deposition of metals (for example, nickel can be the metal deposited but other electroless deposition systems may be used); this approach may be suitably used to form a conducting layer on an insulating surface and may be applied to any substrate material.
2. The silver mirror process of depositing silver metal onto an insulating surface (e.g. onto glass to make mirrors) may be used.
3. Also a suspension of silver or conductive carbon may be sprayed onto the surface of the mandrel (e.g. Electrodag™) and the solvent allowed to evaporate.

The deposition vessel may be assembled from a container that includes the anode(s), manifolds and mandrel. The mandrel may be held between the end-caps so that initial electrode on the mandrel is connected to one terminal of a DC power supply and held in a position relative to anodes in the deposition vessel to achieve the desired current density on different parts of the component to be manufactured. The anodes may be connected to the other terminal of the power supply to complete the circuit. The work piece may contain the part to be manufactured together with one or more witness samples to provide material test pieces deposited at the same time as the specific work piece. Any premanufactured fittings that may be incorporated into the part to form a single piece may also be held together with the mandrel into the end caps of the vessel.

Electrolytes contained in separate holding tanks may be pumped to the deposition vessel to sequentially deposit the desired material (see worked examples below). The electrolyte in each holding tank may be circulated through a filter pump with a 1 μm filter to provide cleaning and agitation of the stock solution. Once the deposition vessel is full of electrolyte, DC current may be passed to the anodes, individually or collectively, to deposit metal ions from the electrolyte onto the work piece. The amount of metal deposited depends on the current density at the work piece. Deposition rates may be calculated a priori from test pieces of known area exposed to ionic currents for a given time. The thickness of deposit so formed may be determined from mass measurements or cross-sectional microscopy or by masking a specific place on the test piece and measuring the step change in height in the deposit with a profilometer. The current flowing at each electrode per time may be monitored during deposition using an amp/minute meter. The electrolyte may continue to flow through the deposition vessel during deposition to ensure constant replenishment of the electrolyte and provide sufficient agitation. Once the desired thickness of metal has been deposited, the electrolyte may be drained from the deposition vessel and returned to the holding tank.

The first metal deposited may be a sacrificial layer to protect the inside surface of the part to be manufactured from the later processes of removal of the mandrel material. If this is the case, the selection of this initial sacrificial layer and the metal of the inner surface layer is important as a selective etchant is required to remove the sacrificial layer and stop at the metal that forms the inside surface of the finished piece.

The deposition vessel may then be purged with a mixture of air and water to remove the electrolyte. This cleaning water may be diverted to a separate tank or tanks for reclamation of the different metal ions.

The deposition vessel may then be filled with the next electrolyte in the sequence and the deposition process repeated.

Following the final deposition the deposition vessel may be drained, purged with air/water mixture and then air. The deposition vessel may then be dissembled and the work piece removed.

The mandrel may then be removed from the inside of the work piece in a number of ways depending on the mandrel material:

1. Plastic extrusion or moulding: exposure to suitable solvent vapour (for example, butyl acetate or dichloromethane or tetrachloroethylene or cyclohexanone and methyl ethyl ketone) in a proprietary vapour degreasing apparatus.
2. Wax: by heating the part to above the melting temperature of the wax and draining away the liquid wax, followed by degreasing.
3. Cooling the material. This may be suitable for materials that are cryo-sensitive and become brittle below a certain temperature.
4. Heating the material to temperatures at which the material deforms or decomposes.
5. Exposure to hot caustic. This may be suitable, for example, for certain plastic extrusions or 3D printed materials.

3D print materials may also be dissolved in solvents according to the manufacturer's instructions.

Finally, the temporary electrode material may be removed along with any sacrificial metal layer by the use of a selective etchant.

Following completion of the manufacturing of the part, it may be placed in a suitable oven for heat treatment to develop the microstructure in the component as desired.

In the second and fourth aspects of the invention (relating to a cradle), an alternative method is used to achieve the structures of earlier aspects of the invention. The system comprises a device to hold the work piece (the work piece cradle). A robotic arm may transfer the work piece cradle from one solution bath to another and hold it in that solution for a given time. The solution baths may contain different electrolytes, etchants or rinse agents. The solution baths may be independently heated, stirred, ultrasonically excited, and monitored for ion concentration, pH and temperature.

The system may comprise a plurality of work piece cradles. The robotic arm may transfer a plurality of work piece cradles at the same time, each containing multiples of the same work piece or different work pieces each with different configurations of electrodes. Each cradle may be excited at different electrodes independently, that is with different electrical current and for different times and in different sequences.

The work piece cradle is similar to the deposition chamber in that it holds the work piece and positions the non-consumed anodes in the desired positions relative to the work piece. Electrical connections are provided to the work piece and (for example, insoluble) anode.

Multiple electrodes may be included in different positions to deposit in different regions and at different deposition rates (current density). Non-conducting field modifiers may be positioned between the electrodes and work piece to modify the electric field distribution, providing further control of current density and hence local deposition rates.

The work piece cradle differs from the deposition chamber in that it is not a closed vessel but consists of an open cage. When using the cradle, the heating, agitation and monitoring of the solution is conducted in the individual solution baths.

Whether a deposition vessel or a cradle is chosen may depend on the size, shape and number of work pieces to be produced.

One suitable embodiment of the system of the invention is shown in FIG. 4. Schematic diagrams of possible cradle arrangements are shown in FIGS. 5 and 6. An example workflow is shown in FIG. 7. Examples 3 and 4 describe possible embodiments of the invention, using a cradle.

The cradle may be assembled from an open cage that includes the anode(s), manifolds and mandrel. The mandrel may be held between the end-caps so that the initial electrode on the mandrel is connected to one terminal of a DC power supply and held in a position relative to anodes in the cradle to achieve the desired current density on different parts of the component to be manufactured. The anodes may be connected to the other terminal of the power supply to complete the circuit. The work piece may contain the part to be manufactured together with one or more witness samples to provide material test pieces deposited at the same time as the specific work piece. Any premanufactured fittings that may be incorporated into the part to form a single piece may also be held together with the mandrel into the end caps of the cradle.

The electrolyte in each solution bath may be agitated. Once the cradle is lowered into the solution bath, DC current may be passed to the anodes, individually or collectively, to deposit metal ions from the electrolyte onto the work piece. The amount of metal deposited depends on the current density at the work piece. Deposition rates may be calculated a priori from test pieces of known area exposed to ionic currents for a given time. The thickness of deposit so formed may be determined from mass measurements or cross-sectional microscopy or by masking a specific place on the test piece and measuring the step change in height in the deposit with a profilometer. The current flowing at each electrode per time may be monitored during deposition using an amp/minute meter. Once the desired thickness of metal has been deposited, the cradle may be lifted out of the solution bath.

The first metal deposited may be a sacrificial layer to protect the inside surface of the part to be manufactured from the later processes of removal of the mandrel material. If this is the case, the selection of this initial sacrificial and the metal of the inner surface layer is important as a selective etchant is required to remove the sacrificial layer and stop at the metal that forms the inside surface of the finished piece.

The cradle may be then lowered into a solution bath containing rinsing medium (i.e. cleaning water) for a given time. The cradle may then be lifted out and lowered into a solution bath containing the next electrolyte in the sequence and the deposition process repeated.

Following the final deposition and rinse, the cradle may be dissembled and the work piece removed.

The mandrel and the temporary electrode material may be removed along with any sacrificial metal layer by the use of a selective etchant.

Also provided is a system for electrodepositing a plurality of electrolytes onto a substrate in a single deposition chamber, in which the system comprises (i) a substrate;

(ii) a deposition chamber containing the substrate in which the chamber has an inlet and an outlet and in which the chamber comprises at least one anode with connection to a source of electrical current;

(iii) a plurality of electrolyte reservoirs for an electrolyte solution connected to the deposition chamber through the inlet; and (iv) a rinse medium reservoir connected to the deposition chamber through the inlet.

A method for electrodeposition of different metals from a plurality of electrolytes on a substrate in which the electrodeposition occurs in a single deposition chamber comprising using this system is also provided.

Preferred aspects of the second and subsequent aspects of the invention are as for the first aspect mutatis mutandis.

The invention will now be further described in the following Examples which are present for the purposes of illustration only and should not be construed as being limitations on the invention. Reference is made in the Examples to the following drawings in which.

Figure 1:
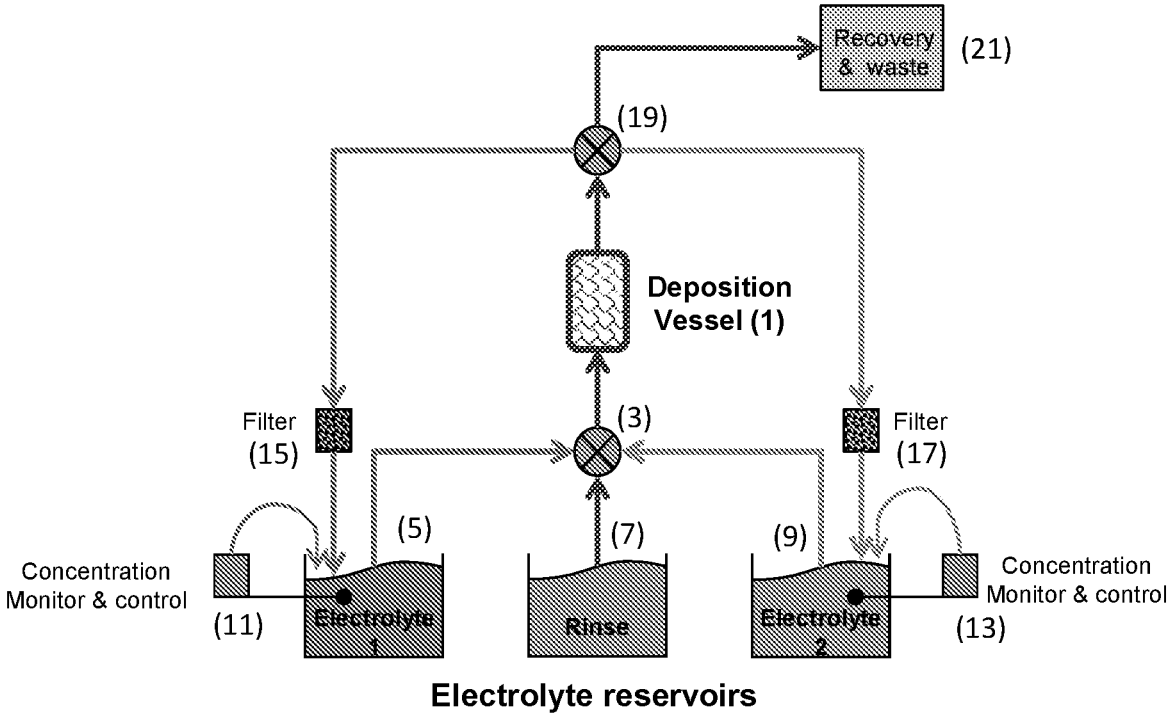
FIG. 1 shows a schematic diagram of the arrangement for depositing more than one electrolyte in a deposition chamber.

In FIG. 1, a deposition chamber ("deposition vessel") (1) is shown in fluid connection via a control valve (3) to an electrolyte reservoir (5) containing "Electrolyte 1", a rinse reservoir (7) and an electrolyte reservoir (9) containing "Electrolyte 2". Each of electrolyte reservoirs (5) and (9) are under the control of optional concentration monitors (11) and (13) respectively. The feeds of fresh electrolyte via separate fluid connection circuits into electrolyte reservoirs (5) and (9) are provided with optional filters (15) and (17) respectively. The feed of fresh electrolyte and waste spent electrolyte is controlled by three-way valve (19) which is in fluid connection with a suitable waste receptacle (21).

In use the system of the invention can therefore be operated to provide flows of electrolyte into the deposition chamber. The concentration of the electrolyte in the electrolyte reservoirs can be independently monitored and controlled.

In some embodiments, the electrolyte can be recycled from the deposition chamber back into the electrolyte reservoirs. Alternatively, the electrolyte solution from the deposition chamber can be removed after use.

Figure 2:
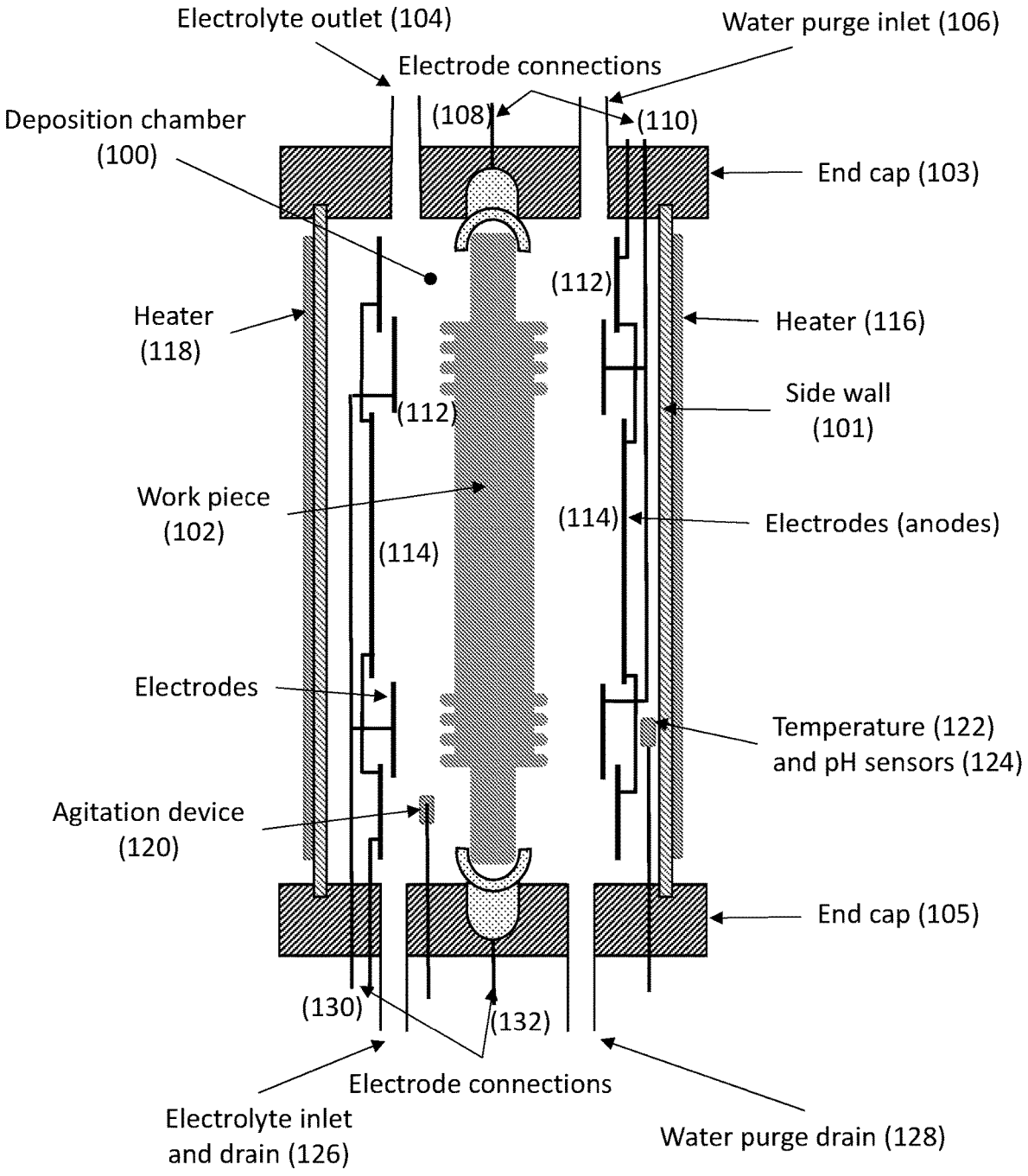
FIGS. 2 and 3 show schematic diagrams of example deposition chambers.

In FIG. 2, a deposition chamber (100) is shown in which a substrate (or work piece) (102) is shown.

The chamber is formed from a sidewall (101) and end caps (103, 105). The chamber is provided with an electrolyte outlet (104) and a rinsing medium (water purge) inlet (106) in end cap (103). Electrode connections (108, 110) are shown in end cap (103) for the electrodes (anodes) (112, 114). The chamber is provided with an external heater (116, 118), an internal agitation device (120), an internal temperature sensor (122) and a pH sensor (124). The internal agitation device (120) is not shown in detail. In end cap (105), there is provided an electrolyte inlet and drain (outlet) (126) and a rinsing medium (water purge) outlet (drain) (128). Electrode connections (130, 132) are shown in end cap (105).

Figure 3:
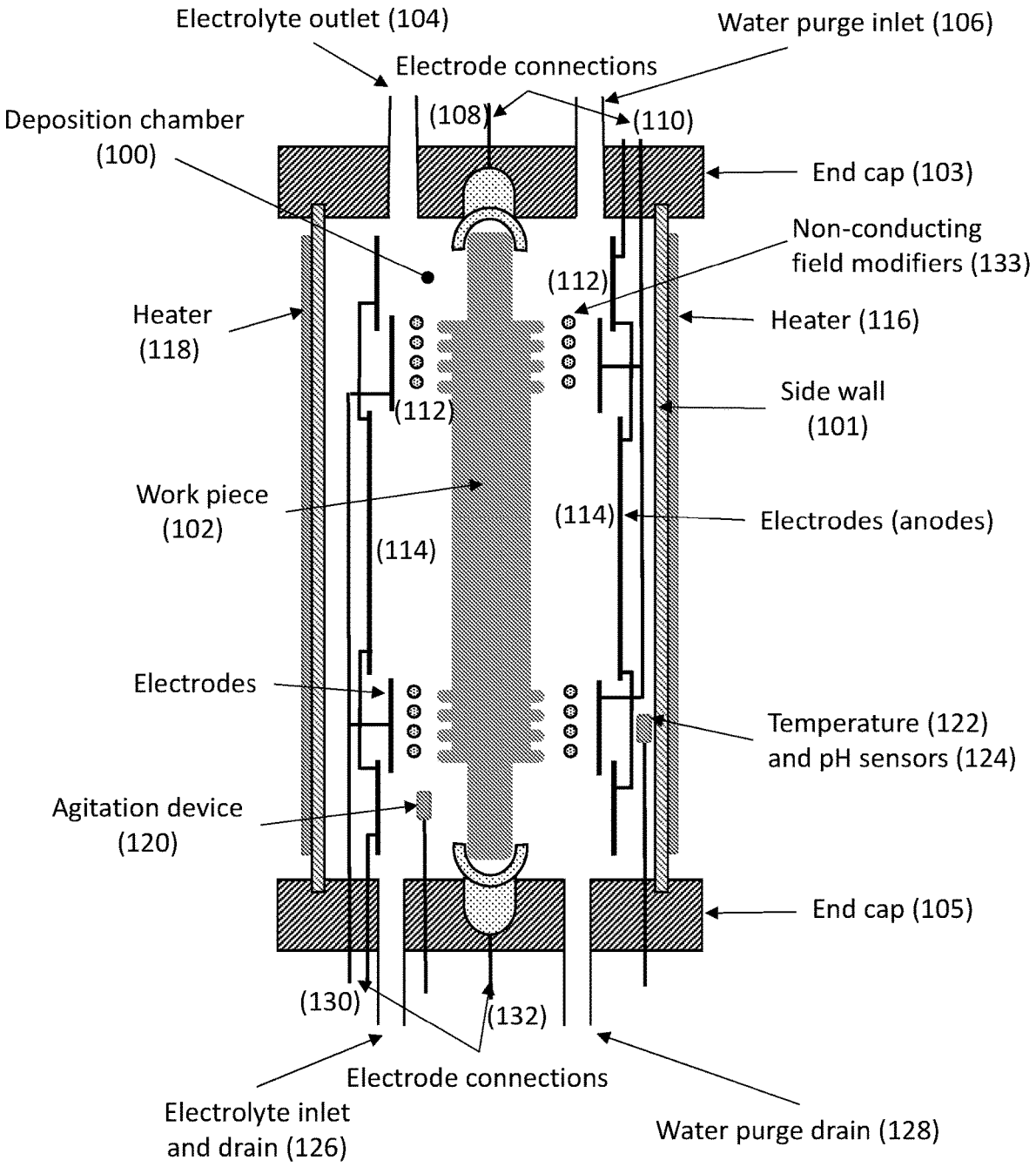

FIG. 3 shows a deposition chamber (100) with the features of FIG. 2, but with the addition of non-conducting field modifiers (133) positioned between the electrodes (anodes) (112, 114) and the work piece (102).

Figure 4:
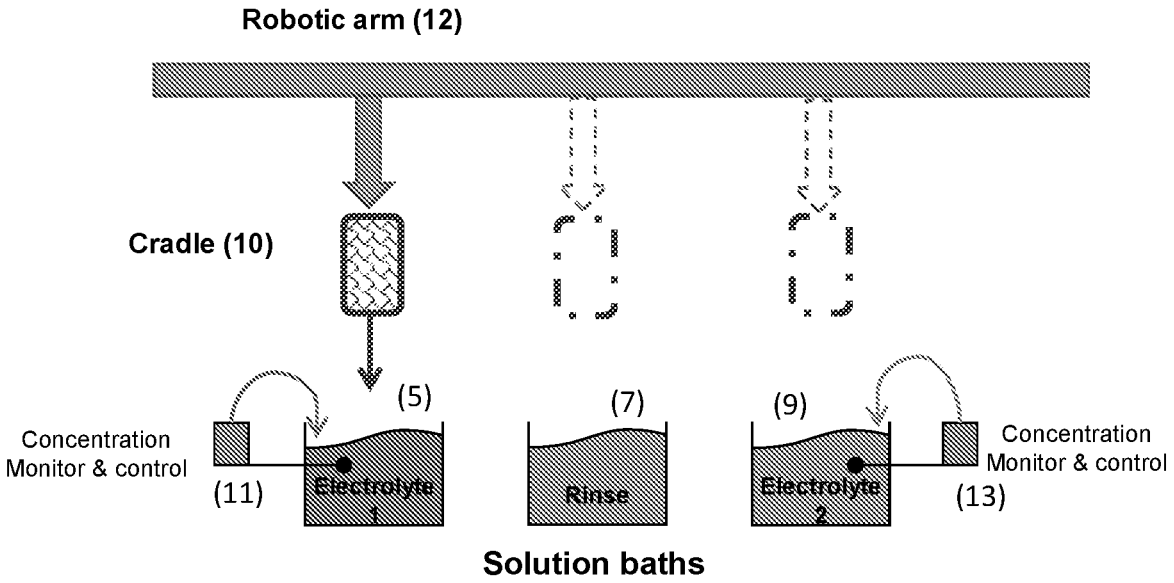
FIG. 4 shows a schematic diagram of the arrangement for depositing a work piece cradle into a series of electrolytic baths and rinsing baths. The electrolytic baths may be independently heated, stirrer and monitored for ion concentration, pH and temperature.

In FIG. 4, a cradle (10) is shown attached to a robotic arm (12). Three solution baths are shown, containing "Electrolyte 1" in bath (5), "Electrolyte 2" in bath (9), and rinse medium in bath (7). Each solution bath is under the control of optional concentration monitors (11) and (13) respectively.

In use the system of the invention can therefore be operated such that the robotic arm brings the cradle (10) to each solution bath and lowers and raises the cradle into and out of the solution bath. The concentration of the electrolyte in the solution baths can be independently monitored and controlled.

Figure 5:
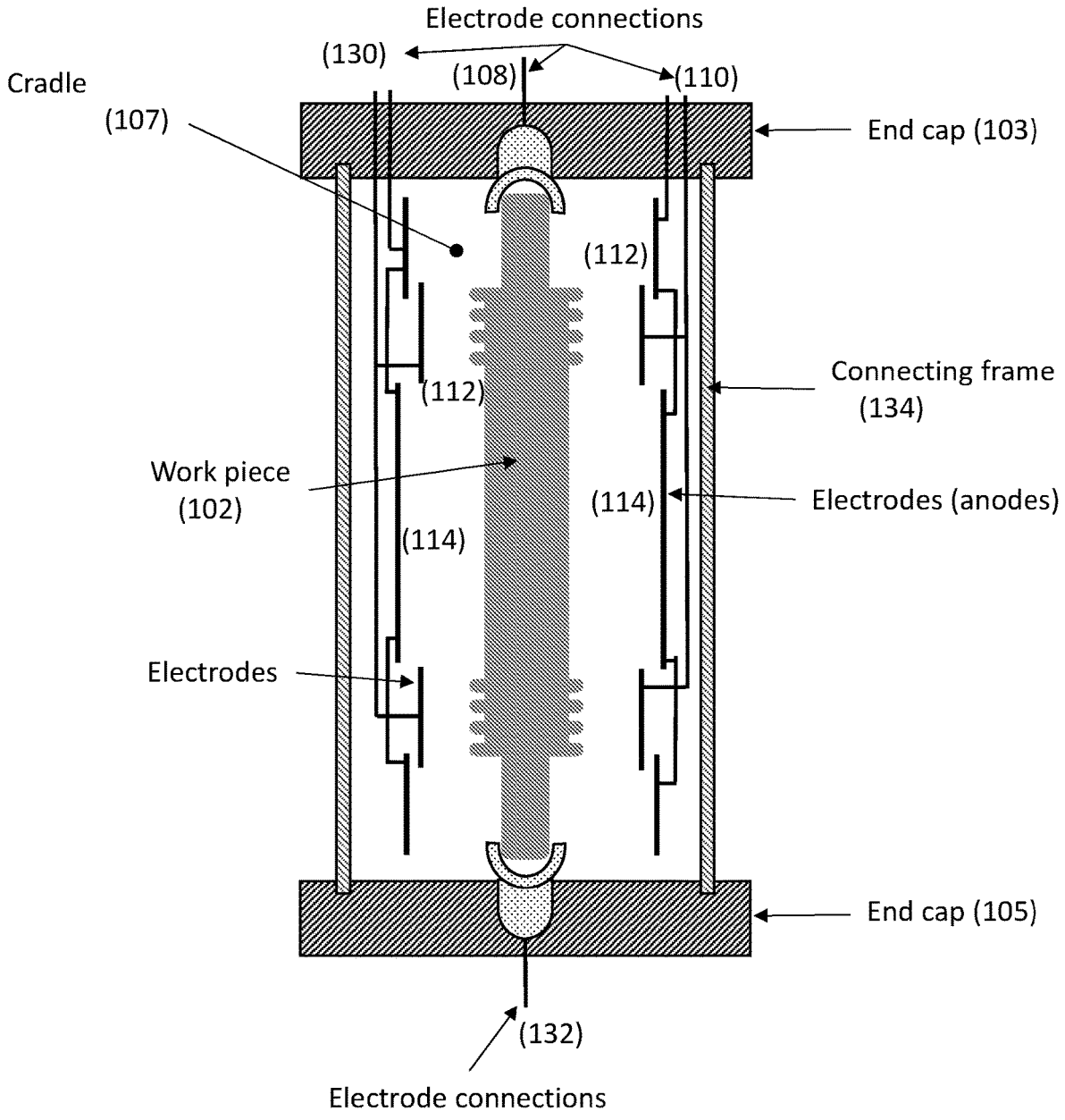
FIGS. 5 and 6 shows schematic diagrams of an example work piece cradle.

In FIG. 5, a cradle (107) is shown in which a substrate (or work piece) (102) is shown. The cradle is formed from a connecting frame (134) and end caps (103, 105). The cradle is provided with electrode connections (108, 110) in end cap (103) for the electrodes (anodes) (112, 114). Electrode connections (130, 132) are shown in end cap (105).

Figure 6:
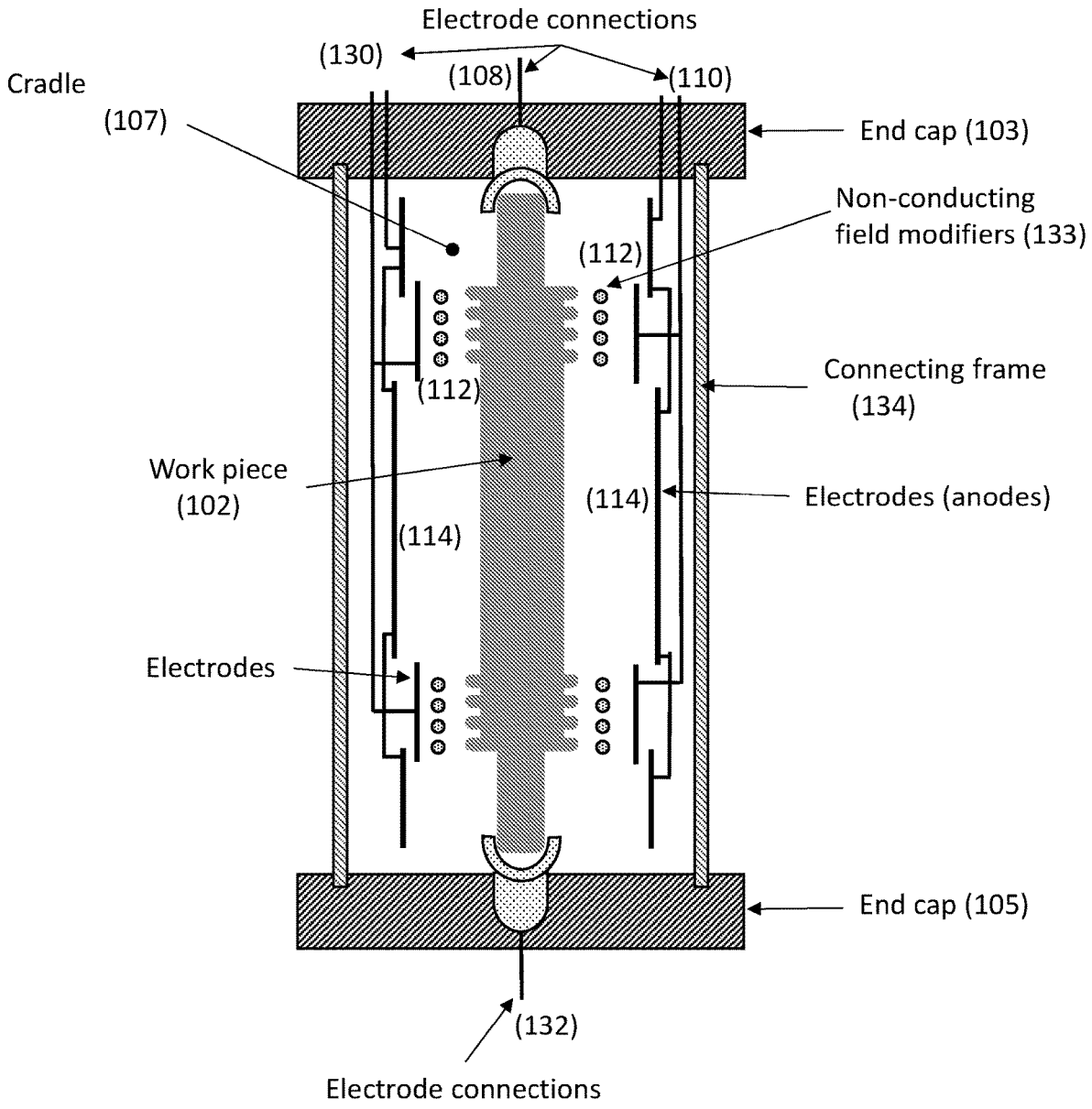

FIG. 6 shows a cradle (107) with the features of FIG. 5, but with the addition of non-conducting field modifiers (133) positioned between the electrodes (anodes) (112, 114) and the work piece (102).

Figure 7:
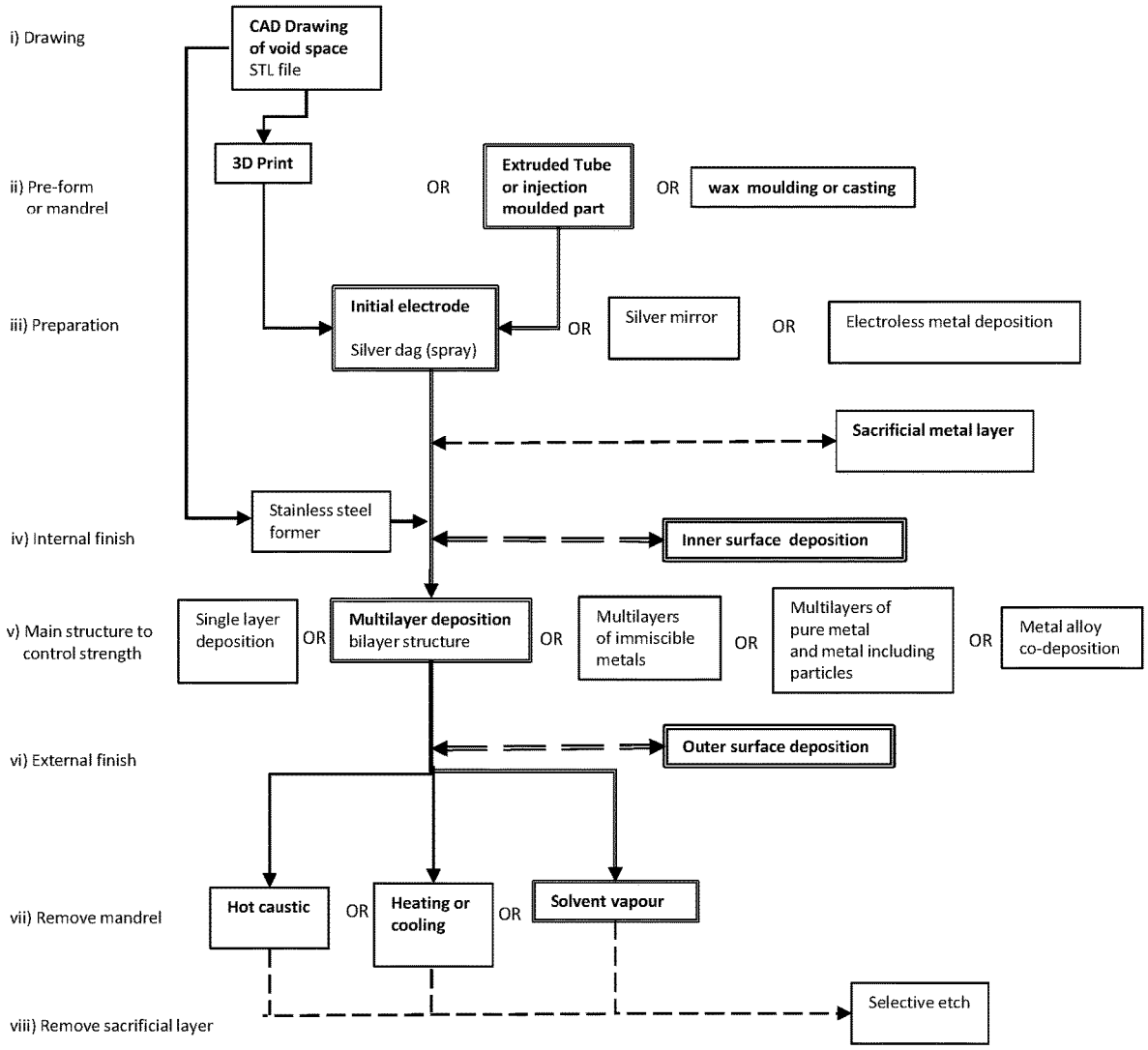
FIG. 7 shows a flow diagram of essential and optional process steps to form an object by the process described herein. Steps highlighted in double lines are the path taken in the Example 1 described herein.

In FIG. 7, the outline of a work-flow is described using a system of the invention. The process may comprise (i) drawing the device to be prepared, for example using CAD system; (ii) preparing the pre-form or mandrel, e.g. using 3D-printing, or extruded tube or injection moulded part, or wax casting; (iii) preparation of the initial electrode, e.g. using silver Electrodag™ spray, or silver mirror or electroless metal deposition, followed by addition of sacrificial metal layer; (iv) internal finish—inner surface deposition; (v) main structure to control strength, for example single layer deposition, or multilayer deposition with a bilayer structure, or multilayers of immiscible metals, or multilayers of pure metal and metal including particles, or metal alloy co-deposition; (vi) external finish—outer surface deposition; (vii) remove mandrel, for example using hot caustic, solvent vapour, heating, or cooling; and (viii) remove sacrificial layer, for example by selective etch. The process may alternatively comprise preparing a stainless steel former from the drawing.

Example 1: Deposition of High Strength Obround Beam

An obround beam was prepared according to a method of the invention as follows:

1. A polystyrene extrusion with the interior dimensions of the obround beam (16 mm×10 mm) and a length of 300 mm was sprayed with silver Electrodag™ to produce a thin even coating and the solvent allowed to evaporate. Total surface area=1.3 $dm^2$.
2. The coated extrusion was placed in the deposition vessel so that it was in contact with the end-cap central electrodes and the circuit checked for good electrical contact.
3. The deposition vessel was then assembled and with pipes and electrical connections made. Non-consuming anodes were positioned to provide an even deposition over the entire surface area of the mandrel.
4. Holding tanks containing the electrolytes to be used were continually agitated through a filter pump and maintained at the desired temperature. These were:
   (i) Nickel sulphamate ($Ni(NH_2SO_3)_2,4H_2O$) at a concentration of 80-100 g/L+nickel chloride ($NiCl_2$)+HCl, T=30° C. pH<3. Anode material was pure nickel. Ethylenediaminetetraacetic acid (EDTA) was used as a complexing agent and surfactants added as required ~5 mL/L to prevent gas bubbles forming at the cathode.
   (ii) Copper sulphate at a concentration of 80-100 g/L+12-15% $H_2SO_4$, T=30° C., pH 1.5-2. Copper alloyed with 3% phosphorous (Cu3% P) used as an anode material in the holding tank. Ethylenediaminetetraacetic acid (EDTA) was used as a complexing agent and surfactants added as required to prevent gas bubbles forming at the cathode.
5. Internal surface deposition: The nickel electrolyte was pumped into the deposition vessel and Ni deposited at a current density of 2 $A/dm^2$ for 30 minutes (5 μm).
6. Multi-layer deposition: The deposition vessel was first flushed with a water air mixture and then filled with the copper electrolyte. The current was connected in the reverse polarity and energized for 5 seconds, then in the normal polarity at a current density of 1.5 $A/dm^2$ for 3 minutes. The vessel was then flushed with the water air mixture and filled with the nickel electrolyte and Ni deposited at a current density of 2 $A/dm^2$ for 3 minutes. This sequence was repeated 100 times.
7. External surface deposition: The nickel electrolyte was pumped into the deposition vessel and Ni deposited at a current density of 2 $A/dm^2$ for 30 minutes (5 μm).
8. The deposition vessel was flushed with a water air mixture, drained and dried. The part was removed from the deposition vessel and placed in a vapour degreasing apparatus. Butyl acetate solvent was passed through the inside of the part until all of the polystyrene mandrel had been removed.

The material making up the resulting part has a tensile yield strength (0.2% plastic strain) of 750 MPa, an ultimate tensile strength of 1500 MPa and strain to failure of 2%.

Example 2: Deposition of Bellows Integrated Couplings

A flexible bellows with integral flanges and fixing holes is prepared according to a method of the invention as follows:

1. A 3 dimensional printed hollow mandrel is generated from a computer aided design drawing of the interior surface of the bellows (internal diameter 15 mm and an overall length of 100 mm) that consists of a corrugated region and flanges at each end extending to a diameter of 35 mm. The mandrel is coated with silver using the silver mirror process. Silver is removed from the areas of the mandrel that will form the fixing holes. Total surface area=0.65 $dm^2$.

2. The silvered mandrel is placed in the deposition vessel so that it is in contact with the end-cap central electrodes and the circuit checked for good electrical contact.
3. The deposition vessel is then assembled and with pipes and electrical connections made. Non-consuming anodes are positioned to provide different deposition conditions at the corrugated section of the bellows and the flanged areas at each end of the mandrel. Non-conductive field modifiers may be positioned between the anodes and work piece as required.
4. Electrolytes to be used are as described in Example 1.
5. Internal surface deposition: The nickel electrolyte is pumped into the deposition vessel and Ni deposited at a current density of 2 A/dm$^2$ for 15 minutes (5 μm) over the whole surface area.
6. Multi-layer deposition: The deposition vessel is first flushed with a water air mixture and then filled with the copper electrolyte. The current is connected in the reverse polarity and energized for 5 seconds, then in the normal polarity at a current density of 1.5 A/dm$^2$ for 1.5 minutes across the whole surface area and then a further 3 minutes at the flange area only. The vessel is then flushed with the water air mixture and filled with the nickel electrolyte and Ni deposited at a current density of 2 A/dm$^2$ for 1.5 minutes only in the area of the corrugations. This sequence is repeated 100 times.
7. External surface deposition: The nickel electrolyte is pumped into the deposition vessel and Ni deposited over the whole work piece at a current density of 2 A/dm$^2$ for 15 minutes (5 μm).
8. The deposition vessel is flushed with a water air mixture, drained and dried. The part is removed from the deposition vessel and flushed internally with caustic soda at 90° C. until the mandrel has been removed, followed by vapour degreasing.

Example 3: Deposition of Heat Exchanger with the Couplings Joined into the Part

A heat-exchange vessel with integral pipe couplings is prepared according to a method of the invention as follows:

1. A computer aided design drawing of the interior surface of the heat-exchanger is created so that it can be wrapped around the component to be cooled to maximise the cooling efficiency. The shape may be a hollow form with approximate dimensions of, for example, 50 mm×50 mm×3 mm and include pipe runs to allow fluid in and out of the vessel. The shape may include mesas positioned to maintain the 3 mm thickness of the hollow form. An aluminium mould is created by computer aided machining from which wax casts can be made. The wax cast is sprayed with silver Electrodag™ to produce a thin even coating and the solvent allowed to evaporate. Total surface area of approximately 0.65 dm$^2$.
2. The silver coated wax is placed in a cradle so that it is in contact with the end-cap central electrodes and the circuit checked for good electrical contact.
3. The cradle is then assembled and electrical connections made. Non-consuming anodes are positioned to provide different deposition conditions at the edges of the heat-exchanger to those of the flat areas.
4. Electrolytes to be used are as described in Example 1.
5. Internal surface deposition: The cradle is lowered into the nickel electrolyte and Ni deposited at a current density of 2 A/dm$^2$ for 15 minutes (5 μm) over the whole surface area.
6. Multi-layer deposition: The cradle is removed from the nickel electrolyte tank and lowered into a rinsing bath. The cradle is then removed from the rinsing bath and lowered into the copper electrolyte. The current is connected in the reverse polarity and energized for 5 seconds, then in the normal polarity at a current density of 1.5 A/dm$^2$ for 1.5 minutes across the whole surface area. The cradle is then removed from the copper electrolyte tank and lowered into a rinsing bath. The cradle is then lowered into the nickel electrolyte and Ni deposited at a current density of 2 A/dm$^2$ for 30 seconds only around the edges of the heat exchanger. This sequence is repeated 100 times.
7. Addition of pipe couplings: The part is then removed from the cradle and proprietary pipe couplings placed onto the pipe ends.
8. External surface deposition: The cradle is lowered into the copper electrolyte and Cu deposited at a current density of 1.5 A/dm$^2$ for 150 minutes (50 μm) over the whole part including the couplings so that they become integrated into the part.
8. The cradle is then removed from the copper electrolyte tank and lowered into a rinsing bath. The part is removed from the cradle and placed in an oven at a temperature 30° C. above the melting temperature of the wax until the wax has been drained from the part, followed by vapour degreasing.

Example 4: Deposition of Concentric Spiral Tube Heat Exchanger

A heat-exchanger consisting of 3 concentric pipes, each separated from each other in the shape of a spiral is prepared according to a method of the invention as follows:

1. A 3 dimensional printed wax spiral is generated from a computer aided design drawing of the interior of the inner most pipe of the heat exchanger, for example, with dimensions of 5 mm diameter solid, in a helical shape 25 mm in diameter and 100 mm in length. The resulting wax mandrel is coated with silver using the silver mirror process. Total surface area of approximately 0.45 dm$^2$.
2. The silvered coated wax mandrel is placed in a cradle so that it is in contact with the end-cap central electrodes and the circuit checked for good electrical contact.
3. The cradle is then assembled and electrical connections made. Non-consuming anodes are positioned to provide an even deposition over the entire surface area of the mandrel.
4. Electrolytes to be used are as described in Example 1.
5. First pipe deposition: The cradle is lowered into the copper electrolyte and Cu deposited at a current density of 1.5 A/dm$^2$ for 100 minutes (50 μm).
6. The cradle is then removed from the copper electrolyte tank and lowered into a rinsing bath. The part is removed from the cradle and dipped in molten wax to build up an even 2.5 mm wax deposit on the part. Pipe inlets and outlets are created by attaching polystyrene tube to the ends of the part, embedded in the wax. The resulting wax mandrel is coated with silver using the silver mirror process.

7. Second pipe deposition: The cradle is lowered into the copper electrolyte and Cu deposited at a current density of 1.5 A/dm$^2$ for 200 minutes (50 μm).
8. The cradle is then removed from the copper electrolyte tank and lowered into a rinsing bath. The part is removed from the cradle and dipped in molten wax to build up an even 2.5 mm wax deposit on the part. Pipe inlets and outlets are created by attaching polystyrene tube to the ends of the part, embedded in the wax. The resulting wax mandrel is coated with silver using the silver mirror process.
9. Third pipe deposition: The cradle is lowered into the copper electrolyte and Cu deposited at a current density of 1.5 A/dm$^2$ for 15 minutes.
10. Multilayer deposition: The cradle is then removed from the copper electrolyte tank and lowered into a rinsing bath. The cradle is then lowered into the nickel electrolyte and Ni deposited at a current density of 2 A/dm$^2$ for 5 minutes. The cradle is then removed from the nickel electrolyte tank and lowered into a rinsing bath. The cradle is then lowered into the copper electrolyte. The current is connected in the reverse polarity and energized for 5 seconds, then in the normal polarity at a current density of 1.5 A/dm$^2$ for 15 minutes. This sequence is repeated 50 times.
11. External surface deposition: The nickel electrolyte is pumped into the deposition vessel and Ni deposited at a current density of 2 A/dm$^2$ for 15 minutes (5 μm).
12. The cradle is then removed from the nickel electrolyte tank and lowered into a rinsing bath. The part is removed from the cradle and placed in an oven at a temperature 30° C. above the melting temperature of the wax until the wax has been drained from the part. The part is then placed in a vapour degreasing apparatus. Butyl acetate solvent is passed through the inside of the part until all of the polystyrene tubes and traces of wax have been removed.

Example 5: Deposition of Concave Mirror

A concave mirror is prepared according to a method of the invention as follows:

1. A convex stainless steel mandrel with the curvature and dimensions of the mirror to be formed is constructed by computer aided machining with, for example, a diameter of 100 mm. The mandrel may include flanges around the edges of the mirror that provide structural rigidity and fixing points for attachment to a supporting structure. The part of the mandrel corresponding to the mirror surface may be polished to a high surface finish.
2. The mandrel is placed in the deposition vessel so that it is in contact with the end-cap central electrodes and the circuit checked for good electrical contact.
3. The deposition vessel is then assembled and with pipes and electrical connections made. Non-consuming anodes are positioned to provide different deposition conditions at the convex section of the mandrel and the flanged areas at edge of the mandrel.
4. Silver deposition: A silver electrolyte (typically, silver cyanide) is pumped into the deposition vessel and Ag deposited on the convex section only at a current density of 2 A/dm$^2$ for 150 minutes (25 μm).
5. The deposition vessel is flushed with a water air mixture and then filled with the copper cyanide electrolyte. Cu is deposited on the convex section only at a current density of 1.5 A/dm$^2$ for 1 minutes (0.5 μm).
6. The deposition vessel is flushed with a water air mixture and then filled with the copper electrolyte of Example 1. Cu is deposited over the whole surface area at a current density of 1.5 A/dm$^2$ for 100 minutes (50 μm).
7. Multilayer deposition: The vessel is flushed with a water air mixture and then filled with the nickel electrolyte of Example 1 and Ni deposited at a current density of 2 A/dm$^2$ for 5 minutes. The vessel is flushed with a water air mixture and then filled with the copper electrolyte of Example 1. The current is connected in the reverse polarity and energized for 5 seconds, then in the normal polarity at a current density of 1.5 A/dm$^2$ for 15 minutes. This sequence is repeated 50 times.
8. External surface deposition: The deposition vessel is flushed with a water air mixture and the nickel electrolyte is pumped into the deposition vessel and Ni deposited at a current density of 2 A/dm$^2$ for 30 minutes (5 μm).
9. The deposition vessel is flushed with a water air mixture, drained and dried. The part is removed from the deposition vessel and gentle heated on a hot plate until the part comes away from the mandrel. The mandrel may then be reused.

The invention claimed is:

1. A system for electrodepositing different metals onto a substrate from a plurality of electrolytes to form an article, in which the system comprises (i) a removable substrate that is removable from the article to be formed via electrodeposition;

(ii) a cradle containing the substrate in which the cradle comprises a plurality of anodes with connection to a source of electrical current, wherein each anode is located at a different position relative to the substrate;

(iii) a plurality of electrolyte solution baths, wherein each electrolyte bath is configured to electrodeposit a different metal onto the substrate; and (iv) a rinse medium bath, wherein the system is configured such that each anode of the plurality of anodes is configured so as be able to receive a different electrical current from another anode of the plurality of anodes.

2. A system as claimed in claim 1, wherein the system comprises a robotic arm configured to move the cradle between electrolyte solution baths.

3. A system as claimed in claim 1, wherein the system comprises a plurality of cradles.

4. A system as claimed in claim 1, wherein the system comprises a non-conducting field modifier positioned between the substrate and an anode.

5. A system as claimed in claim 1, wherein the substrate is thermolabile, cryosensitive or soluble.

6. A system as claimed in claim 1, wherein at least one anode is an insoluble anode.

7. A system as claimed in claim 1, in which each electrolyte solution includes one or more transition metal ions.

8. A system as claimed in claim 7, in which the one more transition metal ions is selected from the group consisting of vanadium (V), chromium (Cr), manganese (Mn), iron (Fe), cobalt (Co), nickel (Ni), copper (Cu), and combinations thereof.

9. A system as claimed in claim 1, in which at least one electrolyte solution includes one or more noble metal ions selected from the group consisting of ruthenium (Ru), rhodium (Rh), palladium (Pd), silver (Ag), osmium (Os), iridium (Ir), platinum (Pt) and gold (Au), and combinations thereof.

10. A system as claimed in claim 1, in which at least one electrolyte solution includes one more metal ions selected from the group consisting of silver (Ag), gold (Au), palladium (Pd), copper (Cu), iron (Fe), cobalt (Co), nickel (Ni), zinc, (Zn) and tin (Sn), or combinations thereof.

11. A system as claimed in claim 10, in which at least one electrolyte solution comprises nickel and cobalt.

12. A system as claimed in claim 1, wherein each of the plurality of electrolyte solution baths includes one or more metal ions is selected from the group consisting of vanadium (V), chromium (Cr), manganese (Mn), iron (Fe), cobalt (Co), nickel (Ni), copper (Cu), ruthenium (Ru), rhodium (Rh), palladium (Pd), silver (Ag), osmium (Os), iridium (Ir), platinum (Pt) and gold (Au), zinc, (Zn) and tin (Sn), and combinations thereof.

13. A method for electrodeposition of different metals from a plurality of electrolytes on a substrate to form an article, in which the substrate is held in a cradle, comprising using a system as claimed in claim 1, said method comprising forming an article by electrodeposition of different metals from a plurality of electrolytes on a removable substrate.

14. The method of claim 13, further comprising the step of removing the substrate from the article.

* * * * *